US005531078A

United States Patent [19]

Day et al.

[11] Patent Number: 5,531,078

[45] Date of Patent: Jul. 2, 1996

[54] LOW VOLUME INLET RECIPROCATING COMPRESSOR FOR DUAL EVAPORATOR REFRIGERATION SYSTEM

[75] Inventors: James Day, Scotia, N.Y.; Stephen Searl, Rockford, MI.

[73] Assignee: General Electric Company, Schenectady, N.Y.

[21] Appl. No.: 364,863

[22] Filed: Dec. 27, 1994

[51] Int. Cl.[6] ..... F25B 5/02

[52] U.S. Cl. ..... 62/199; 62/296; 417/503

[58] Field of Search ..... 62/296, 199; 417/312, 417/503

[56] References Cited

U.S. PATENT DOCUMENTS 4,910,972 3/1990 Jaster ..... 62/335

5,228,308 7/1993 Day et al. ..... 62/198

*Primary Examiner*—William E. Tapolcai

*Attorney, Agent, or Firm*—Patrick K. Patnode; Marvin Snyder

[57] ABSTRACT

A low volume inlet reciprocating compressor suitable for use in a dual evaporator refrigeration cycle. The compressor includes a cylinder having an inlet port and an outlet port disposed in a housing. A flexible conduit having an inlet passage formed therein extends between the inlet port and an inlet in the housing, and a check valve is connected to the inlet passage so as to prevent refrigerant flow out of the conduit. The inlet passage is located as close as possible to the inlet port. A suction muffler can be located in the housing with one end connected to a second inlet in the housing and another end connected to the check valve. A discharge tube is provided between the outlet port and outlet opening in the housing.

19 Claims, 2 Drawing Sheets

LOW VOLUME INLET RECIPROCATING COMPRESSOR FOR DUAL EVAPORATOR REFRIGERATION SYSTEM

BACKGROUND OF THE INVENTION

This invention relates generally to refrigerator compressors and more particularly to a reciprocating compressor having a low volume inlet.

Energy efficiency is an extremely important factor in the design of refrigeration systems. This is particularly so for household refrigerators having multiple temperature requirements, e.g., fresh food and freezer compartments. The refrigeration cycle traditionally used in household refrigerators utilizes a single evaporator operated at the low freezer temperature. This cycle is not energy efficient because it produces a refrigeration effect which is appropriate for the freezer compartment but lower than need be for the fresh food compartment.

One approach to better energy efficiency has been the development of more efficient refrigeration cycles. For example, U.S. Pat. No. 5,228,308 issued Jul. 20, 1993 to James Day et al discloses a refrigeration cycle which includes at least two evaporators. A first evaporator is connected to receive at least a portion of the refrigerant discharged from the condenser and a second evaporator is connected to receive a portion of the refrigerant discharged from the first evaporator. A flow control unit is connected to receive at least a portion of the refrigerant discharged from each one of the evaporators. The flow control unit is repeatedly operable to alternately connect one of the evaporators in refrigerant flow relationship with the compressor.

As the flow control unit switches the refrigerant flow relationship, the compressor inlet pressure alternates between the pressures of the two evaporators, a difference of about 15–25 psia. During normal operation, the flow control unit typically switches every 10 seconds. Thus, this refrigeration system has been best implemented using a high-side-case rotary compressor having a low volume inlet. Conventional reciprocating compressors do not work as well because they typically have a low-side-case and thus a high volume inlet. When the inlet pressure of a reciprocating compressor switches to a lower level, a large volume of gas is pumped out of the case to bring the case pressure down to the lower level. This introduces large inefficiencies in the process. However, because reciprocating compressors are generally more efficient and less expensive than rotary compressors, they are more attractive for use in household refrigerators in general.

Accordingly, there is a need for a low volume inlet reciprocating compressor suitable for use in a dual evaporator refrigeration cycle.

SUMMARY OF THE INVENTION

The above-mentioned need is met by the present invention which provides a reciprocating compressor comprising a housing and a cylinder having an inlet port and an outlet port disposed in the housing. A flexible conduit having an inlet passage formed therein extends between the cylinder inlet port and an inlet in the housing, and a check valve is connected to the inlet passage so as to prevent refrigerant flow out of the conduit. The inlet passage is located as close as possible to the inlet port.

A directed suction muffler can be located in the housing with one end connected to a second inlet in the housing and another end connected to the check valve. A discharge tube is provided between the outlet port and an outlet formed in the housing. This arrangement is such that a reciprocating compressor is provided with a low volume inlet without compromising other compressor systems such as lubrication, suspension and directed suction.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
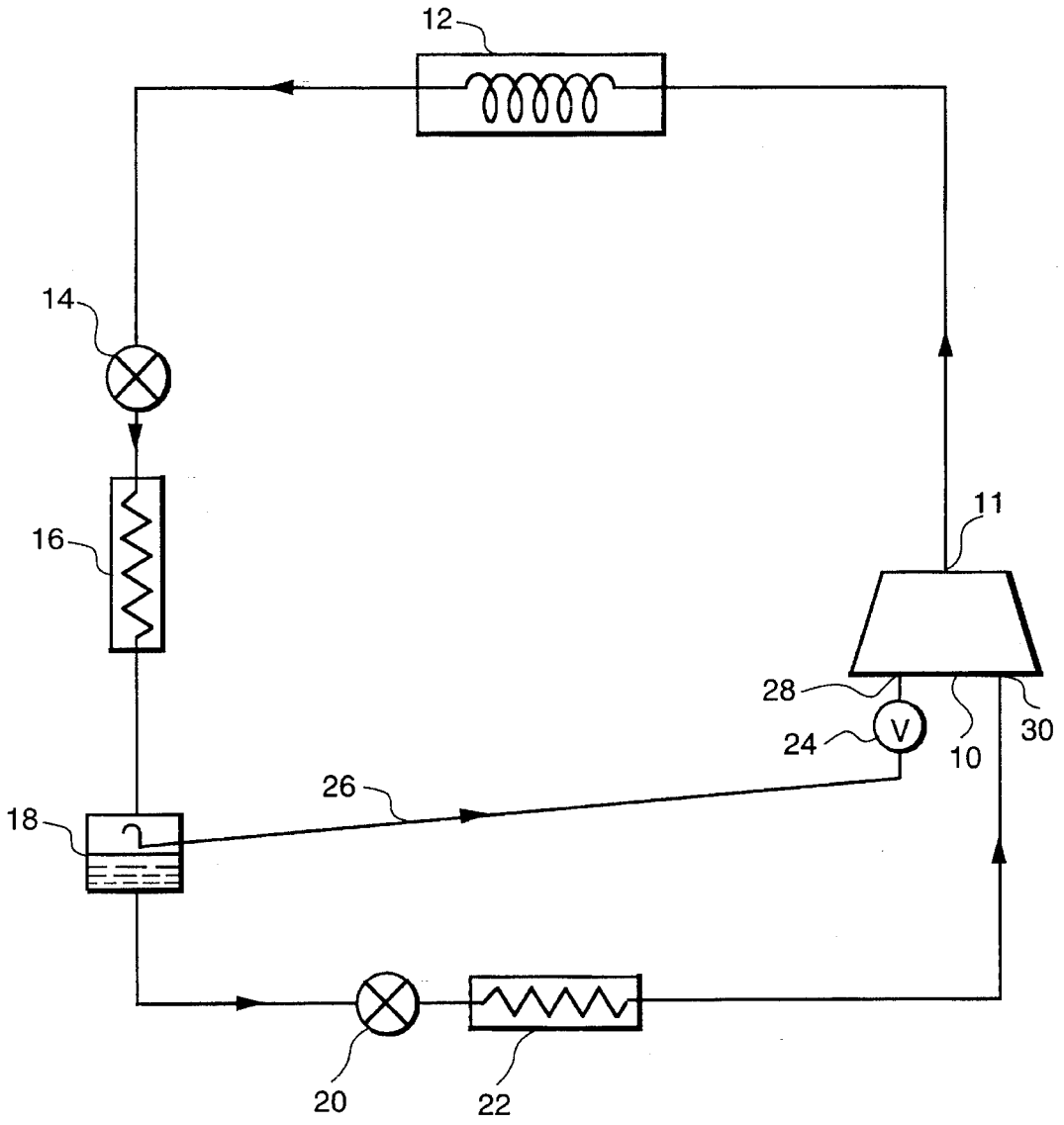
FIG. 1 is a schematic representation of a dual evaporator refrigeration system in accordance with the present invention.

Referring to the drawings wherein identical reference numerals denote the same elements throughout the various views, FIG. 1 shows a refrigeration system utilizing a reciprocating compressor 10 in accordance with the present invention. The compressor 10 has an outlet 11 which is connected to a condenser 12. A first expansion device 14 is connected to the outlet of the condenser 12, and a first evaporator 16 is connected to the outlet of the first expansion device 14. As used herein, the term "expansion device" refers to any device, such as an expansion valve, an orifice or a capillary tube, which reduces the pressure of refrigerant passing therethrough.

The outlet of the first evaporator 16 is connected to the inlet of a phase separator 18. The phase separator 18 comprises a closed receptacle which receives liquid and gaseous phase refrigerant from the first evaporator 16. Liquid refrigerant accumulates in the lower portion of the receptacle and gaseous refrigerant accumulates in the upper portion. A first outlet located at the bottom of the receptacle is connected to a second expansion device 20 which is in turn connected to a second evaporator 22. Thus, liquid refrigerant is supplied to the second evaporator 22 via the second expansion device 20. The phase separator 18 also has a second outlet which is connected to an active valve 24. Particularly, a conduit 26 extends from the upper portion of the phase separator 18 to the active valve 24. The conduit 26 is arranged so that liquid refrigerant cannot enter its open end but vapor refrigerant can. Thus, vapor refrigerant is supplied to the active valve 24.

The compressor 10 has a first inlet 28 which is connected to the active valve 24 and a second inlet 30 which is connected to the outlet of the second evaporator 22. The active valve 24 is preferably a solenoid valve which can be opened and closed in response to a number measurable physical attributes of the refrigeration system such as pressure, temperature, density or mass flow rate. Valve control is described in more detail in the above-mentioned U.S. Pat. No. 5,228,308, which is herein incorporated by reference. In a refrigerator, the first evaporator 16 would be arranged to cool the fresh food compartment of the refrigerator and the second evaporator would be arranged to cool the freezer compartment of the refrigerator.

Figure 2:
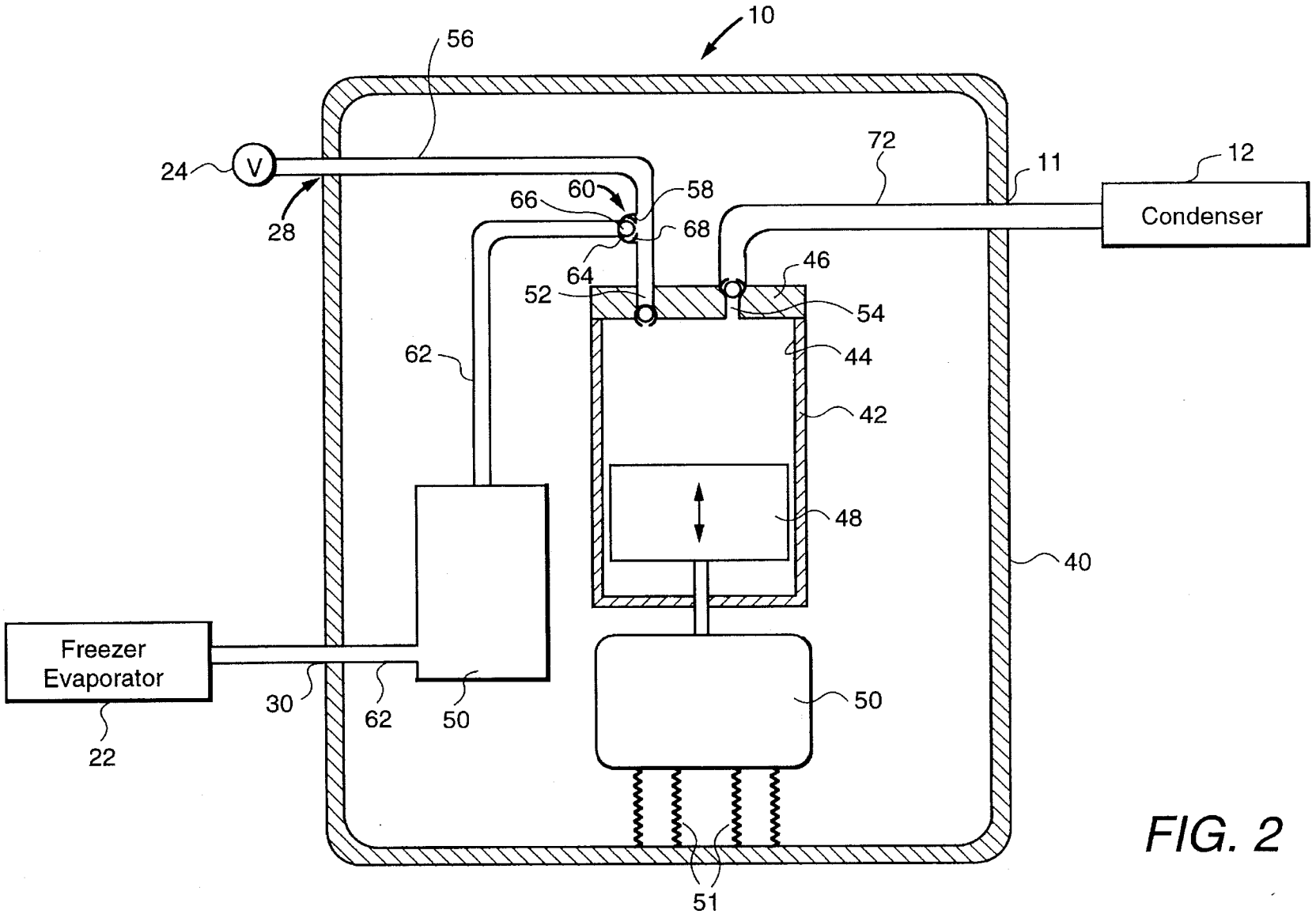
FIG. 2 is a schematic sectional view of the reciprocating compressor of the present invention.

Turning to FIG. 2, the reciprocating compressor 10 of the present invention is shown schematically. The compressor 10 comprises an outer shell or housing 40 and a cylinder block 42 disposed inside the housing 40. A cylinder 44 is formed in the cylinder block 42, and a cylinder head 46 is attached to the cylinder block 42, closing the open end of the cylinder 44. A reciprocating piston 48 disposed in the cylinder 44 is driven back-and-forth by a motor 50. The cylinder block 42 and motor 50 are supported in the housing 40 by conventional suspension means 51. An inlet port 52 and an outlet port 54 are formed in the cylinder head 46. As is known in the art, the ports 52,54 are provided with check valves or the like so that refrigerant is admitted into the cylinder 44 through the inlet port 52 as the piston 48 is moving away from the cylinder head 46 and compressed refrigerant is discharged from the cylinder 44 through the outlet port 54 as the piston 48 moves towards the cylinder head 46.

A first conduit 56 extends between the inlet port 52 and the first inlet 28 of the compressor 10, thereby connecting the inlet port 52 to the active valve 24. The first conduit 56 can comprise flexible tubing, such as accordion-type tubing, and is sealed to prevent refrigerant leakage therefrom. By being flexible, the conduit 56 allows for vibration of the cylinder block 42 and reduces noise. Alternatively, the first conduit 56 can comprise hard tubing which is mounted to the cylinder head 46 with a flexible fitting such as a rubber grommet. An inlet passage 58 is formed in the first conduit 56 at a point adjacent to the cylinder head 46. The inlet passage 58 should be located as close as possible to the inlet port 52.

A check valve 60 is connected to the inlet passage 58, and a second conduit 62 extends between the check valve 60 and the second inlet 30 of the compressor 10, thereby connecting the check valve 60 to the outlet of the second evaporator 22. The check valve 60 can be any type of known check valve such as the leaf-type or ball-type. As shown in FIG. 2, the check valve 60 is a conventional ball-type check valve comprising a seat 64, ball 66 and cage 68 arranged so as to prevent refrigerant flow from the first conduit 56 to the second conduit 62, but to permit refrigerant flow from the second conduit 62 to the first conduit 56 if the pressure in conduit 62 exceeds the pressure in conduit 56.

The second conduit 62 has a suction muffler apparatus 70 disposed therein through which refrigerant flows. The suction muffler apparatus 70 is a plastic casing which muffles the noise of the compression process. In addition, the suction muffler apparatus 70 is vented (not hermetic) to allow the interior of the housing 40 to be at the exit pressure of the second evaporator 22 (typically 15–20 psia) and to permit oil in the refrigerant to return to the sump (not shown) in the bottom of the housing 40 while protecting refrigerant from the heat in the housing interior. Such a suction muffler apparatus is well known in the art and needs not be described in further detail. As an alternative, the second conduit 62 and the suction muffler 70 can be omitted so that the second inlet 30 does not have directed suction. In this case, refrigerant from the second evaporator 22 would fill the housing 40 and the check valve 60 would simply be in fluid communication with the housing interior.

A discharge tube 72 extends between the cylinder outlet port 54 and the compressor outlet 11 formed in the housing 40. The outlet 11 is connected to the condenser 12 so that high pressure refrigerant is supplied to the condenser 12. Like the first conduit 56, the discharge tube 72 is preferably made of flexible tubing to allow for vibration of the cylinder block 42.

By way of example, the first evaporator 16 operates at approximately 40 psia and contains refrigerant at a temperature of approximately 25° F. for cooling the fresh food compartment, and the second evaporator 22 operates at approximately 20 psia and contains refrigerant at a temperature of approximately −10° F. for cooling the freezer compartment. Thus, vaporous refrigerant at approximately 40 psia is delivered to the active valve 24, and refrigerant at approximately 20 psia is delivered to the second inlet 30 and enters the second conduit 62. When the active valve 24 is closed, the higher pressure refrigerant does not enter the first conduit 56. The check valve 60 is thus opened by the pressure in the second conduit 62, allowing refrigerant from the second conduit 62 to enter the first conduit 56 through the inlet passage 58. This refrigerant is drawn into the cylinder 44 through the inlet port 52. High pressure (approximately 150 psia) refrigerant is discharged through the outlet port 54 and the discharge tube 72 for delivery to the condenser 12.

When the active valve 24 is open, the higher pressure refrigerant from the first evaporator 16 does enter the first conduit 56, causing the check valve 60 to close which prevents back flow of refrigerant into the second conduit 62 and the housing 40. As before, refrigerant is drawn from the first conduit 56 into the cylinder 44 where it is compressed to the discharge pressure and then fed to the condenser 12. However, the compression ratio in this instance is 40/150 instead of 20/150. As mentioned above, the inlet passage 58 is located in the first conduit 56 as close as possible to the inlet port 52. Thus, the volume of tubing in which the pressure alternates between the two evaporator pressures is minimal.

The reciprocating compressor of the present invention can also be used in refrigeration systems having more than two evaporators. In which case, the lowest pressure evaporator is connected to the second inlet 30 and the remaining evaporators are all connected to the first inlet 28 via respective solenoid valves.

The foregoing has described a reciprocating compressor having a low volume inlet which can be used in a dual evaporator refrigeration system. While specific embodiments of the present invention have been described, it will be apparent to those skilled in the art that various modifications thereto can be made without departing from the spirit and scope of the invention as defined in the appended claims.

What is claimed is:

1. A reciprocating compressor comprising:

a housing having a cylinder block disposed therein;

a cylinder disposed within said cylinder block having an inlet port and an outlet port;

a reciprocating piston disposed within said cylinder;

a first conduit having an inlet passage, said first conduit extending between said inlet port and a first inlet of said compressor;

a check valve connected to said inlet passage;

a second conduit extending between said check valve and a second inlet of said compressor; and said check valve arranged so as to prevent flow from said first conduit to said second conduit but to permit flow from said second conduit to said first conduit if the pressure of said second conduit exceeds the pressure of said first conduit.

2. The reciprocating compressor, according to claim 1, wherein said inlet passage is adjacent to said inlet port.

3. The reciprocating compressor, according to claim 1, wherein said first conduit is flexible.

4. The reciprocating compressor, according to claim 1, further comprising a suction muffler located in said housing and connected to said check valve.

5. The reciprocating compressor, according to claim 1, further comprising a discharge tube extending between said outlet port and another opening in said housing.

6. The reciprocating compressor, according to claim 1, further comprising a motor connected to said reciprocating piston for moving said piston back and forth.

7. In a refrigeration system having a first evaporator, a second evaporator and an active valve connected to receive a portion of the refrigerant discharged from said first evaporator, a reciprocating compressor comprising:

a housing having a first inlet connected to said active valve and a second inlet connected to said second evaporator;

a cylinder block disposed in said housing and having a cylinder formed therein, said cylinder having an inlet port and an outlet port;

a conduit extending between said inlet port and said first inlet and having an inlet passage formed therein; and a check valve connected to said inlet passage so as to prevent flow out of said conduit.

8. The reciprocating compressor of claim 7 wherein said inlet passage is adjacent to said inlet port.

9. The reciprocating compressor of claim 7 wherein said conduit comprises accordion-type tubing.

10. The reciprocating compressor of claim 7 further comprising a suction muffler located in said housing, one end of said suction muffler being connected to said second inlet and another end of said suction muffler being connected to said check valve.

11. The reciprocating compressor of claim 7 further comprising an outlet formed in said housing and a discharge tube extending between said outlet port and said outlet formed in said housing.

12. The reciprocating compressor of claim 7 further comprising a piston disposed in said cylinder.

13. A refrigeration system comprising:

a condenser;

a first evaporator connected to receive at least a portion of the refrigerant discharged from said condenser;

a second evaporator connected to receive a portion of the refrigerant discharged from said first evaporator;

an active valve connected to receive a portion of the refrigerant discharged from said first evaporator; and a reciprocating compressor comprising a housing having a first inlet connected to said active valve and a second inlet connected to said second evaporator, a cylinder block disposed in said housing and having a cylinder formed therein, said cylinder having an inlet port and an outlet port, a conduit extending between said inlet port and said first inlet and having an inlet passage formed therein, and a check valve connected to said inlet passage so as to prevent flow out of said conduit.

14. The refrigeration system of claim 13 wherein said inlet passage is adjacent to said inlet port.

15. The refrigeration system of claim 13 wherein said conduit comprises accordion-type tubing.

16. The refrigeration system of claim 13 further comprising a suction muffler located in said housing, one end of said suction muffler being connected to said second inlet and another end of said suction muffler being connected to said check valve.

17. The refrigeration system of claim 13 further comprising an outlet formed in said housing and a discharge tube extending between said outlet port and said outlet formed in said housing.

18. The refrigeration system of claim 17 wherein said condenser is connected to said outlet formed in said housing.

19. The refrigeration system of claim 13 further comprising a piston disposed in said cylinder.

* * * * *